US009269557B2

(12) United States Patent
Otsuka

(10) Patent No.: US 9,269,557 B2
(45) Date of Patent: Feb. 23, 2016

(54) IONIZATION DEVICE, MASS SPECTROMETER INCLUDING THE IONIZATION DEVICE, AND IMAGE GENERATION SYSTEM INCLUDING THE IONIZATION DEVICE

(71) Applicant: CANON KABUSHIKI KAISHA, Tokyo (JP)

(72) Inventor: Yoichi Otsuka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/016,739

(22) Filed: Sep. 3, 2013

(65) Prior Publication Data

US 2014/0070093 A1 Mar. 13, 2014

(30) Foreign Application Priority Data

Sep. 7, 2012 (JP) ..... 2012-197207

(51) Int. Cl.

| | |
|---|---|
| ***H01J 49/16*** | (2006.01) |
| ***H01J 49/26*** | (2006.01) |
| ***H01J 49/04*** | (2006.01) |
| *H01J 49/00* | (2006.01) |

(52) U.S. Cl.

CPC ..... *H01J 49/16* (2013.01); *H01J 49/0463* (2013.01); *H01J 49/165* (2013.01); *H01J 49/26* (2013.01); *H01J 49/0004* (2013.01)

(58) Field of Classification Search

CPC ... H01J 49/0463; H01J 49/0004; H01J 49/16; H01J 49/165; H01J 49/26; G01Q 30/02; G01Q 60/38; G01N 2001/028; G01N 35/10

USPC ..... 850/62; 250/288

See application file for complete search history.

(56) References Cited

U.S. PATENT DOCUMENTS

| | | | | |
|---|---|---|---|---|
| 5,945,678 | A * | 8/1999 | Yanagisawa | 250/423 F |
| 6,566,653 | B1 * | 5/2003 | Gerber et al. | 250/288 |
| 7,442,922 | B2 * | 10/2008 | Knebel et al. | 250/306 |
| 7,902,499 | B2 * | 3/2011 | Hiraoka et al. | 250/282 |
| 7,910,881 | B2 | 3/2011 | Nikolaev et al. | |
| 8,384,020 | B2 * | 2/2013 | Jesse et al. | 250/282 |
| 8,450,682 | B2 * | 5/2013 | Hiraoka | 250/288 |
| 8,519,330 | B2 * | 8/2013 | Van Berkel et al. | 250/288 |
| 8,637,813 | B2 * | 1/2014 | Van Berkel et al. | 250/288 |
| 2008/0128614 | A1 * | 6/2008 | Nikolaev et al. | 250/288 |

(Continued)

OTHER PUBLICATIONS

"Introduction to Dynamics and Vibrations" retrieved from http://www.brown.edu/Departments/Engineering/Courses/En4/Notes/vibrations_forced/vibrations_forced.htm (Nov. 4, 2014).*

*Primary Examiner* — Wyatt Stoffa

(74) *Attorney, Agent, or Firm* — Canon USA, Inc., IP Division

(57) ABSTRACT

An ionization device includes an irradiation unit to irradiate at least a region of a surface of a sample with laser light to scatter particles contained on the surface of the sample, a liquid holding unit having a distal end to hold a liquid on an outer periphery of the distal end, an extract electrode to extract ionized ions, and a voltage application unit to apply a voltage between the liquid holding unit and the extract electrode to generate the ions from the liquid held on the outer periphery of the distal end. The region and the distal end are disposed so as not to make contact with each other but to be in close proximity to each other so that the liquid held on the outer periphery of the distal end attracts particles desorbed from the sample as a result of irradiation with the laser light.

26 Claims, 5 Drawing Sheets

(56) References Cited

U.S. PATENT DOCUMENTS

| | | | | |
|---|---|---|---|---|
| 2009/0140137 | A1* | 6/2009 | Hiraoka et al. | 250/282 |
| 2010/0213367 | A1* | 8/2010 | Miller | 250/282 |
| 2011/0020919 | A1* | 1/2011 | Fulton et al. | 435/287.2 |
| 2011/0198495 | A1* | 8/2011 | Hiraoka | 250/282 |
| 2011/0220784 | A1* | 9/2011 | Roach et al. | 250/282 |
| 2012/0080589 | A1* | 4/2012 | Van Berkel et al. | 250/282 |
| 2012/0149009 | A1* | 6/2012 | Levis et al. | 435/5 |
| 2013/0299694 | A1* | 11/2013 | Sato et al. | 250/288 |
| 2014/0070088 | A1* | 3/2014 | Otsuka | 250/282 |
| 2014/0070089 | A1* | 3/2014 | Otsuka | 250/282 |
| 2014/0070094 | A1* | 3/2014 | Otsuka | 250/288 |
| 2014/0072476 | A1* | 3/2014 | Otsuka | 422/83 |
| 2014/0223616 | A1* | 8/2014 | Huang et al. | 850/9 |
| 2015/0034821 | A1* | 2/2015 | Kyogaku et al. | 250/287 |

* cited by examiner

IONIZATION DEVICE, MASS SPECTROMETER INCLUDING THE IONIZATION DEVICE, AND IMAGE GENERATION SYSTEM INCLUDING THE IONIZATION DEVICE

BACKGROUND OF THE INVENTION

1. Field of the Invention

The present invention relates to devices and methods for ionizing solid samples.

2. Description of the Related Art

There exists a technique for ionizing a solid sample in an atmospheric pressure environment in order to analyze components in the surface of the solid sample.

U.S. Pat. No. 7,910,881 discusses a method in which a fine region of a surface of a solid sample is irradiated with laser light and fine particles desorbed from the sample are taken into an opposedly disposed liquid to have components in the fine particles ionized. According to this method, the fine region of the solid sample is irradiated with focused laser light in an atmospheric pressure environment. Upon being irradiated with the laser light, fine particulates of the sample desorb from the surface thereof. Then, as a solvent is brought close to the region that has been irradiated with the laser light, the fine particulate matter is taken into the solvent.

In the method discussed in U.S. Pat. No. 7,910,881, the solvent is held at a leading end of a capillary, and the fine particles desorbed from the sample are taken into the solvent. Then, the solvent flows within the capillary tube to an ionization unit provided at the other end of the capillary, where the solvent is ionized. That is, the method discussed in U.S. Pat. No. 7,910,881 requires, as illustrated in FIG. 1, that both a mechanism for supplying the solvent to the leading end of the capillary and a mechanism for allowing the solvent containing the fine particles to flow to the ionization unit be provided in the capillary tube, which inevitably leads to a complicated configuration. In addition, an ionization process for analyzing the components and a process of taking the fine particles into the solvent are carried out at distinct times and locations, and thus an operation for transporting the solvent to the ionization unit is required. Accordingly, a time in a second range is required between the time at which the sample is irradiated with the laser light to be taken into the solvent and the time at which the components are measured (ionization).

SUMMARY OF THE INVENTION

According to an aspect of the present invention, an ionization device includes a laser light irradiation unit configured to irradiate at least a region of a surface of a sample with laser light to scatter particles, a liquid holding unit having a distal end thereof and configured to hold a liquid on an outer periphery of the distal end, an extract electrode configured to extract ionized ions, and a voltage application unit configured to apply a voltage between the liquid and the extract electrode to cause the ions to scatter from the liquid held on the outer periphery of the distal end. In such an ionization device, the region and the distal end are disposed so as not to make contact with each other but to be in close proximity to each other so that the liquid held on the outer periphery of the distal end collects the particles desorbed as a result of being irradiated with the laser light, and the particles are ionized using the liquid held at the distal end.

An exemplary embodiment of the present invention provides an ion analysis device capable of ionizing a component in a fine region of a surface of a sample in an atmospheric pressure environment at high speed and with high efficiency.

Further features of the present invention will become apparent from the following description of exemplary embodiments with reference to the attached drawings.

DESCRIPTION OF THE EMBODIMENTS

Figure 1A:
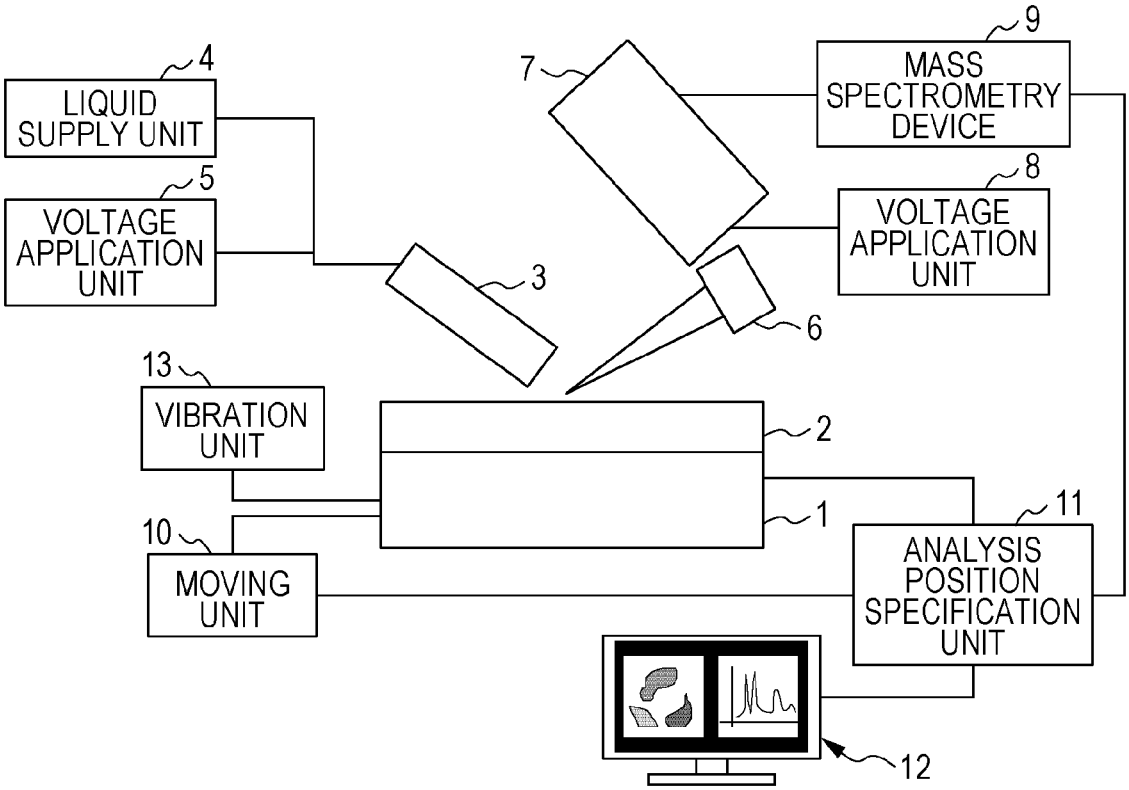
FIGS. 1A and 1B are schematic diagrams each illustrating an image generation system that includes an ionization device according to a first exemplary embodiment.

An ionization device according to an exemplary embodiment of the present invention includes a laser light irradiation unit configured to irradiate at least a region of a surface of a sample with laser light to desorb particles contained on the surface of the sample, a liquid holding unit having a distal end and configured to hold a liquid on an outer periphery of the distal end, an extract electrode configured to extract ionized ions, and a voltage application unit configured to apply a voltage between the liquid and the extract electrode to cause the ions to generate from the liquid held on the outer periphery of the distal end. In the ionization device, the particles desorbed from the sample as a result of being irradiated with the laser light are ionized using the liquid at the end.

Further, the aforementioned region of the surface of the sample and the distal end are disposed so as not to make contact with each other but to be in close proximity to each other so that the liquid held on the outer periphery of the distal end collects the particles desorbed as a result of being irradiated with the laser light. Accordingly, the particles can be ionized efficiently using the liquid held at the distal end.

In an exemplary embodiment of the present invention, the positional relationship between the aforementioned region of the surface of the sample and the distal end of the liquid holding unit is such that a liquid bridge linking the two is not formed by the liquid held at the end and such that the liquid can take in the particles desorbed from the surface of the sample as a result of being irradiated with the laser light.

Although the positional relationship may depend on the size of each constituent element, if a region of the surface of the sample to be irradiated with the laser light (e.g., laser irradiation spot size) is in the micrometer to millimeter range, the distance between the surface of the sample and the distal end (end portion) of the liquid holding unit is preferably 0.1 mm or more but 30 mm or less. More preferably, the distance is 0.1 mm or more but 10 mm or less.

Hereinafter, exemplary embodiments of the present invention will be described in detail.

First Exemplary Embodiment

An ionization device according to a first exemplary embodiment of the present invention includes a liquid supply unit 4 configured to supply a solvent to a sample 2. To that end, a liquid holding unit having a proximal end and a distal end holds a hanging liquid drop 21 on an outer periphery of the distal end. A laser light irradiation unit 6 is disposed so as to irradiate a surface of the sample with laser light.

The laser light irradiation unit 6 is disposed so as to be capable of irradiating a desired location on the surface of the sample with the laser light emitted from a laser light source.

Figure 1B:
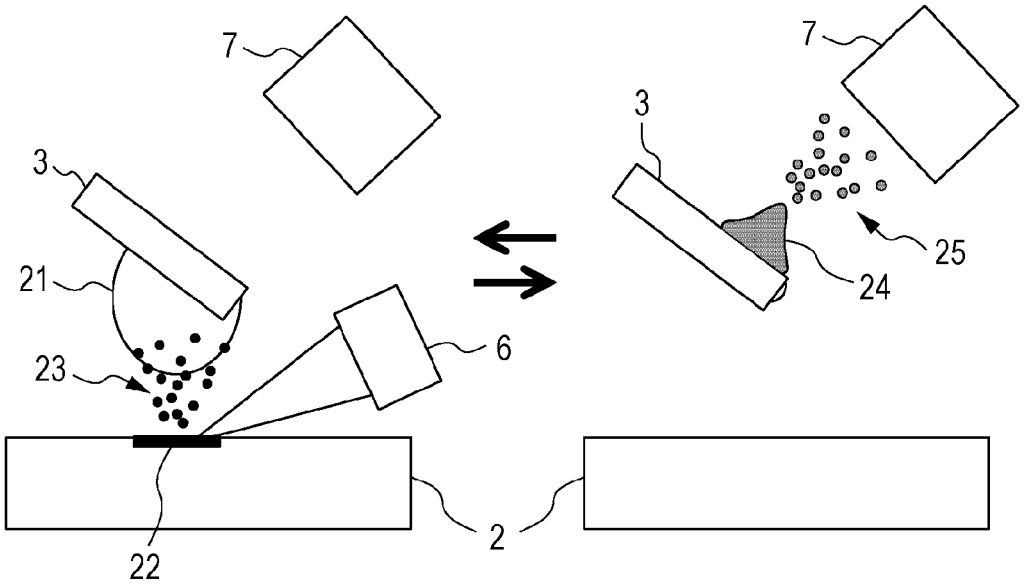

FIGS. 1A and 1B are schematic diagrams each illustrating an image generation system that includes the ionization device according to the first exemplary embodiment of the present invention. FIG. 1A illustrates the entire image generation system, and FIG. 1B illustrates a device system around the distal end of the liquid holding unit, which partially constitutes the image generation system.

A sample 2 is placed on and is supported by a support 1. The sample 2 may be a section (cell group) of biological tissue. A liquid holding unit 3 is a needle-like instrument having a tubular elongated shape. The liquid holding unit 3 is disposed such that an end portion thereof (distal end) is in close proximity to the sample 2 and a proximal end is connected to the liquid supply unit 4, as illustrated in FIGS. 1A and 1B. A flow channel (not illustrated) is formed inside the liquid holding unit 3, and the liquid holding unit 3 is capable of holding, at the distal end thereof, a liquid supplied through the flow channel. The flow channel in the liquid holding unit 3 is in communication with a liquid supply unit 4, and the liquid supply unit 4 supplies a solvent so that a hanging liquid drop 21 is formed at the distal end of the liquid holding unit 3. The solvent is a liquid in which a substance contained in the sample 2 can dissolve as a solute, and the solvent in which the solute has dissolved is referred to as a solution. In the first exemplary embodiment, the solvent is a mixture in which an acid or a base is mixed in a mixture containing water and an organic solvent. The solvent can be supplied continuously from the liquid supply unit 4 to the liquid holding unit 3, and a voltage can be applied to the solvent, while being supplied, by a voltage application unit 5. The solvent that has been supplied to the liquid holding unit 3 then forms a hanging liquid drop 21 at the end of the liquid holding unit 3. The hanging liquid drop 21 is formed in an atmospheric pressure environment. The hanging liquid drop 21 has a small volume of approximately $1\times10^{-12}$ $m^3$ to $1\times10^{-6}$ $m^3$. The hanging liquid drop 21 is retained at a position where the hanging liquid drop 21 does not make contact with the sample 2.

A laser light irradiation unit 6 that emits laser light includes a light source that is arranged such that the laser light hits a fine region 22 of the sample 2 that is in close proximity to the hanging liquid drop 21. The laser light irradiation unit 6 is disposed at a side of the sample 2, that is, at a side of the support 1 where the sample 2 is to be placed.

As a system for checking a focus position of the laser light, a camera for observing an irradiation spot may be included in the laser light irradiation unit 6. Then, by observing light from the focus position with the camera and by adjusting the position of the laser light irradiation unit 6 so that the focus position of the laser light coincides with the fine region 22 of the sample 2, the surface of the sample 2 can be irradiated with the laser light efficiently. When observing the focus position of the laser light, it is preferable to use an optical filter that transmits light in the wavelength band of the laser light. A positioning device (not shown) such as a stepping motor is preferably used to adjust the position of the laser light irradiation unit 6 or the liquid holding unit 3. The positioning device can be connected to a support unit of the laser light irradiation unit 6 or the liquid holding unit 3.

The spot size of the laser light with which the laser light irradiation unit 6 irradiates the surface of the sample 2 has an area of approximately $1\times10^{-12}$ $m^2$ or greater. The spot size can be changed as desired depending on the laser light focusing lens (not illustrated). The laser light irradiation unit 6 preferably includes a drive unit for driving the light source to emit pulsed laser light. The pulsed laser light having a pulse duration in the femtosecond to nanosecond range and a power of 10 $J/m^2$ or greater is preferably used. The wavelength of the laser light may be in any of an ultraviolet range, a visible range, and an infrared range.

The distal end of the liquid holding unit 3, where the hanging liquid drop 21 is held, is located in a space between the fine region 22 and an ion extract electrode 7. Specifically, the liquid holding unit 3, the fine region 22 of sample 2, and the ion extract electrode 7 may be arranged such that fine particulate matter 23 desorbed from the fine region 22 as a result of being irradiated with the laser light can intersect with the hanging liquid drop 21, and such that the fine particulate matter 23 can be transferred from the liquid holding unit 3 to the ion extract electrode 7. The primary positions that allow the above actions to occur are preferably in a linear relationship but may also be in a nonlinear relationship.

The liquid holding unit 3 may be needle-shaped like a capillary tube, conical, round column-shaped, pyramid-shaped, rectangular column-shaped, or elongated narrow plate-shaped. In other words, as long as the liquid holding unit 3 has an elongated shape with a tubular channel thereinside to deliver liquid from the liquid supply unit 4 to the distal end thereof, any elongated shape may be used.

The liquid holding unit 3 preferably includes a hollow flow channel in order to facilitate the supply of the liquid to the outer periphery of the distal end thereof.

Irregularities or a border region between a water-repellent portion and a hydrophobic portion may be provided at the distal end of the liquid holding unit 3 so that the hanging liquid drop 21 can be formed on the outer periphery of the distal end with ease.

The liquid holding unit 3 is preferably formed of a flexible material so that the liquid holding unit 3 may flexibly vibrate relative to the longitudinal axis thereof.

Further, the liquid holding unit 3 preferably includes a flow channel having an opening at an end in order to supply the liquid to the outer periphery of the distal end thereof.

When the surface of the sample 2 is to be scanned with the laser light, that is, when the location of the fine region 22 of the surface of the sample 2 is to be changed, it is preferable to move the relevant constituent elements while maintaining the above-described positional relationship. Specifically, it is preferable to move the sample 2 by using a moving unit 10 while the positions of a laser irradiation optical system and the liquid holding unit 3 are fixed. Alternatively, in a state where the sample 2 is fixed, the laser optical system and the liquid holding unit 3 may be moved to scan the surface of the sample 2 along the in-plane direction thereof while maintaining the positional relationship between the laser optical system and the liquid holding unit 3.

Upon the fine region 22 of the sample 2 being irradiated with the laser light, the fine particulate matter 23 is desorbed from the surface of the sample 2. The fine particulate matter 23 collides with the hanging liquid drop 21 disposed in close proximity thereto and is absorbed into the hanging liquid drop 21. The above processes will be referred to as a first operation mode (mode A). As the fine particulate matter 23 makes contact with the hanging liquid drop 21 of the mixture serving as the solvent, a substance (at least any one of a lipid, a saccharide, and a molecule having a mean molecular weight of 20 or more but less than a hundred million) contained in the sample 2 dissolves in the hanging liquid drop 21, and thus the liquid serving as the solvent changes into a solution. Here, "dissolving in a solvent" refers to a state where molecules, atoms, and fine particles are dispersed in the solvent.

The ion extract electrode 7 and a voltage application unit 8 for applying a voltage to the ion extract electrode 7 are provided in order to generate a Taylor cone 24 at the distal end of the liquid holding unit 3. A large potential difference (1 kV or more but 10 kV or less, or preferably 3 kV or more but 5 kV or less) between the liquid on the liquid holding unit 3 and the ion extract electrode 7 causes the liquid to form the Taylor cone 24. The Taylor cone 24 has a conical shape with the apex thereof oriented toward the ion extract electrode 7.

The charged liquid at the apex of the Taylor cone 24 is pulled off the Taylor cone 24 to form charged liquid droplets 25, and the charged liquid droplets 25 are then sprayed toward the ion extract electrode 7. This liquid contains the fine particulate matter 23. Components in the fine particulate matter 23 are ionized and discharged from the charged liquid droplets 25. The resulting ions are introduced into a mass spectrometer, in which mass-to-charge ratios of the ions are measured. Note that a series of processes including formation of the Taylor cone 24, spraying of the charged liquid droplets 25, and ionization is referred to as electrospray ionization, hereinafter. The above processes will be referred to as a second operation mode (mode B).

With the first exemplary embodiment, the fine particulate matter 23 desorbed from the surface of the sample 2 can be taken into the mixture serving as the solvent containing water, an organic solvent, and an acid or a base and can then be ionized promptly. That is, a time from when the sample 2 is taken into the solvent to ionization can be reduced, which has been difficult with an existing technique, and the measurement time can be reduced. Further, as the fine particulate matter 23 is once taken into the solvent, the fine particulate matter 23 can be dispersed in the solvent, which can enhance interaction with the charged solvent, and thus the number of generated ions can be increased.

The ion extract electrode 7 includes a conductive member and is connected to the voltage application unit 8, and a predetermined voltage is applied to the ion extract electrode 7 by the voltage application unit 8. The ion extract electrode 7 is a structural member for forming a flow path through which ions contained in the liquid droplets 25 that are separated from the Taylor cone 24 are taken in and, for example, is cylindrical in shape. A pump (not illustrated) is connected to the ion extract electrode 7 serving as an ion take-in port, and the ions are attracted to the ion extract electrode 7 along with an outside environment, that is, a surrounding gas. The ions pass through the ion extract electrode 7 in a liquid state or in a gaseous state. Then, the ions fly in a gaseous state in a mass spectrometry device 9. The mass spectrometry device 9 is a time of flight (TOF) mass spectrometer that utilizes a TOF method. The ions fly through a vacuum flight space within the mass spectrometry device 9 and have their mass-to-charge ratios are measured.

Here, by applying a voltage to the solvent intermittently, an electrospray can be generated intermittently. This configuration makes it possible to ionize a substance while limiting duration for which a voltage is applied to the substance that undergoes a change in its characteristics due to a voltage being applied to a minimum.

An image generation system according to the first exemplary embodiment includes a mass spectrometer and an image information generation device.

The mass spectrometer includes an ionization unit and the mass spectrometry device 9.

The ionization unit corresponds to the ionization device that includes the support 1, the liquid holding unit 3, the laser light irradiation unit 6, the ion extract electrode 7, the liquid supply unit 4, and the voltage application units 5 and 8.

As described above, the hanging liquid drop 21 is located at a fine region of the distal end of the liquid holding unit 3. In order to analyze a larger area of the surface of the sample 2, the moving unit 10 for moving the sample 2 in the in-plane direction thereof is provided. The moving unit 10 is connected to an analysis position specification unit 11, and the analysis position specification unit 11 is connected to the mass spectrometry device 9. The analysis position specification unit 11 specifies a region to be analyzed by the mass spectrometry device 9 and moves the support 1 so that the fine region 22 of the sample 2 at the specified position is irradiated with the laser light to be desorbed and the desorbed matter is contained in the hanging liquid drop 21 and the Taylor cone 24.

The analysis position specification unit 11 corresponds to the aforementioned image information generation device. The image information generation device includes an image generation unit that generates image information to be used to display an image on the basis of the result of mass spectrometry (i.e., mass information such as mass spectra) on the target substance at the specified position. The image information may be for a two-dimensional image or a three-dimensional image. The image information outputted from an output unit (not illustrated) of the analysis position specification unit 11 is sent to an image display unit 12 such as a flat panel display connected to the analysis position specification unit 11. The image information is inputted to the image display unit 12 and displayed in the form of an image.

In this manner, carrying out mass spectrometry at multiple positions while changing the specified position along the surface of the sample 2 on the basis of the result of mass spectrometry performed on the specified position makes it possible to display the results of mass spectrometry performed on the sample 2 in the form of an image. The components in the fine particulate matter 23 that is generated from the sample 2 irradiated with the laser light can be found from the result of mass spectrometry. A predetermined component in the biological tissue section is mapped in the image (multilayered display). In addition to the position of the component, the amount of the component is also displayed, and differences in the amount are indicated by varying colors or brightness. In other words, the component distribution of substances contained in the sample 2 can be displayed in the form of an image on the basis of the analyzed mass information and the positional information of the sample 2. Further, it is also possible to display a superimposed image of a microscopic image of the sample 2 obtained in advance and an image indicating the obtained mass of the sample 2.

The ionization device according to the first exemplary embodiment uses a biological tissue section as a sample and a mixture containing water, an organic solvent, and an acid or a base as a solvent. Alternatively, an ionization device according to an exemplary embodiment of the present invention can be applied to other combinations of a sample, a solvent, and a solute. For example, the ratio of water, an organic solvent, and an acid or a base in a solvent can be varied. One of the components in a given ratio may, for example, be 0, that is, one of the components may not be contained. Varying the ratio allows solubility, in the mixture, of a water-soluble molecule and a fat-soluble molecule contained in the sample 2 to be varied, and thus ionization of a desired molecule can be prioritized.

In the ionization device according to the first exemplary embodiment, the voltage application unit 5 applies a voltage to the solvent, and in this case the liquid holding unit 3 is preferably an insulator. Alternatively, an ionization device according to an exemplary embodiment of the present invention may be configured such that the voltage application unit 5 applies a voltage to the liquid holding unit 3 and, as a result, the voltage is applied to the solvent. In this case, the liquid holding unit 3 is preferably formed of a conductor, and the solvent is disposed so as to be in contact with the conductor.

In the ionization device according to the first exemplary embodiment, the liquid holding unit 3 has a flow channel formed therein, and the solvent flows in the flow channel. Alternatively, an ionization device according to an exemplary embodiment of the present invention may be configured such that the liquid supply unit 4 supplies liquid droplets to the liquid holding unit 3 and the liquid droplets flow along the liquid holding unit 3 to the distal end thereof so as to form the hanging liquid drop 21.

In the ionization device according to the first exemplary embodiment, the liquid holding unit 3 has a flow channel formed therein. Alternatively, an ionization device according to an exemplary embodiment of the present invention may include a plurality of flow channels, and distinct solvents may flow in the respective flow channels. In this case, a unit configured to apply distinct voltages to the respective solvents may be provided.

In the ionization device according to the first exemplary embodiment, the ion extract electrode 7 is connected to the voltage application unit 8 that is configured to apply a voltage to the ion extract electrode 7. In this case, the ion extract electrode 7 preferably includes a conductive member, and this conductive member is preferably connected to the voltage application unit 8.

Alternatively, an ionization device according to an exemplary embodiment of the present invention may be configured such that the ion extract electrode 7 is formed of an insulator and a conductive member is disposed on the ion extract electrode 7 at an end portion thereof that is close to the liquid holding unit 3. Then, the voltage application unit 8 may be connected to the conductive member so as to apply a high electric field to the Taylor cone 24.

The ionization device according to the first exemplary embodiment may be used as an ion generation unit not only of a TOF mass spectrometer but also of a quadrupole mass spectrometer, a magnetic field deflection mass spectrometer, ion trap mass spectrometer, and ion cyclotron mass spectrometer.

In the ionization device according to the first exemplary embodiment, the hanging liquid drop 21 and the Taylor cone 24 are formed in an atmospheric pressure environment and the substance is ionized. Here, the atmospheric pressure covers a range of 0.1 to 10 times the standard atmospheric pressure of 101325 Pa. Alternatively, the environment may be in an atmosphere that is the same as a typical room environment, or in an inert gas atmosphere such as a nitrogen atmosphere or an argon atmosphere.

The ionization device according to the first exemplary embodiment is configured such that the solvent continuously flows in the flow channel formed in the liquid holding unit 3 at a constant flow rate. Alternatively, the flow rate (flow speed) of the solvent may be controlled. That is, an increase or a decrease in the flow rate can be set as desired. Thus, by increasing the flow rate if the amount of a substance to be dissolved is large or decreasing the flow rate if the amount of the substance is small, a fluctuation in the concentration of a substance dissolving in the hanging liquid drop 21 can be suppressed, and the substance in the sample 2 can be ionized efficiently. Varying the flow rate also makes it possible to vary the size of the hanging liquid drop 21. The size of the hanging liquid drop 21 corresponds to the size of a region from which the fine particulate matter 23 is to be taken. Further, the size of the region within the fine region 22 of the sample 2 to be irradiated with the laser light depends on the spot size of the laser light and thus correlates with spatial resolution of a mass image. That is, if the spot size of the laser light is increased to irradiate a larger area of the surface of the sample 2, a spatial spread of the fine particulate matter 23 increases, and thus increasing the flow rate leads to an increase in the volume of the hanging liquid drop 21.

That is, a smaller spot size of the laser light leads to improved spatial resolution but increases the number of regions from which the fine particulate matter 23 is to be desorbed, and thus a total measurement time increases. That is, there is a trade-off relationship between the flow rate and the total measurement time, and changing the flow rate makes it possible to control the measurement time. For example, after a mass image is obtained at low spatial resolution, an area in the mass image is specified. Then, a detailed mass image of the specified area is obtained at higher spatial resolution, and thus the measurement can be carried out efficiently.

In the ionization device according to the first exemplary embodiment, the fine region 22 of the sample 2 is irradiated with the laser light continuously in the mode A. Alternatively, the fine region 22 may be irradiated with the laser light intermittently during a given period of time. That is, the surface of the sample 2 may be irradiated with the laser light for a given period of time, and then the irradiation may be stopped for another given period of time. Accordingly, a period in which the laser light interacts with a substance that is easily decomposed by the laser light can be reduced, and thus decomposition of the substance can be suppressed. In addition, the above configuration can suppress a situation where the fine region 22 of the sample 2 is locally heated by the laser light, and thus degradation of the substance to be caused by the heat can be suppressed.

In the ionization device according to the first exemplary embodiment, a voltage is not applied to the ion extract electrode 7 in the mode A but is applied in the mode B.

Figure 2:
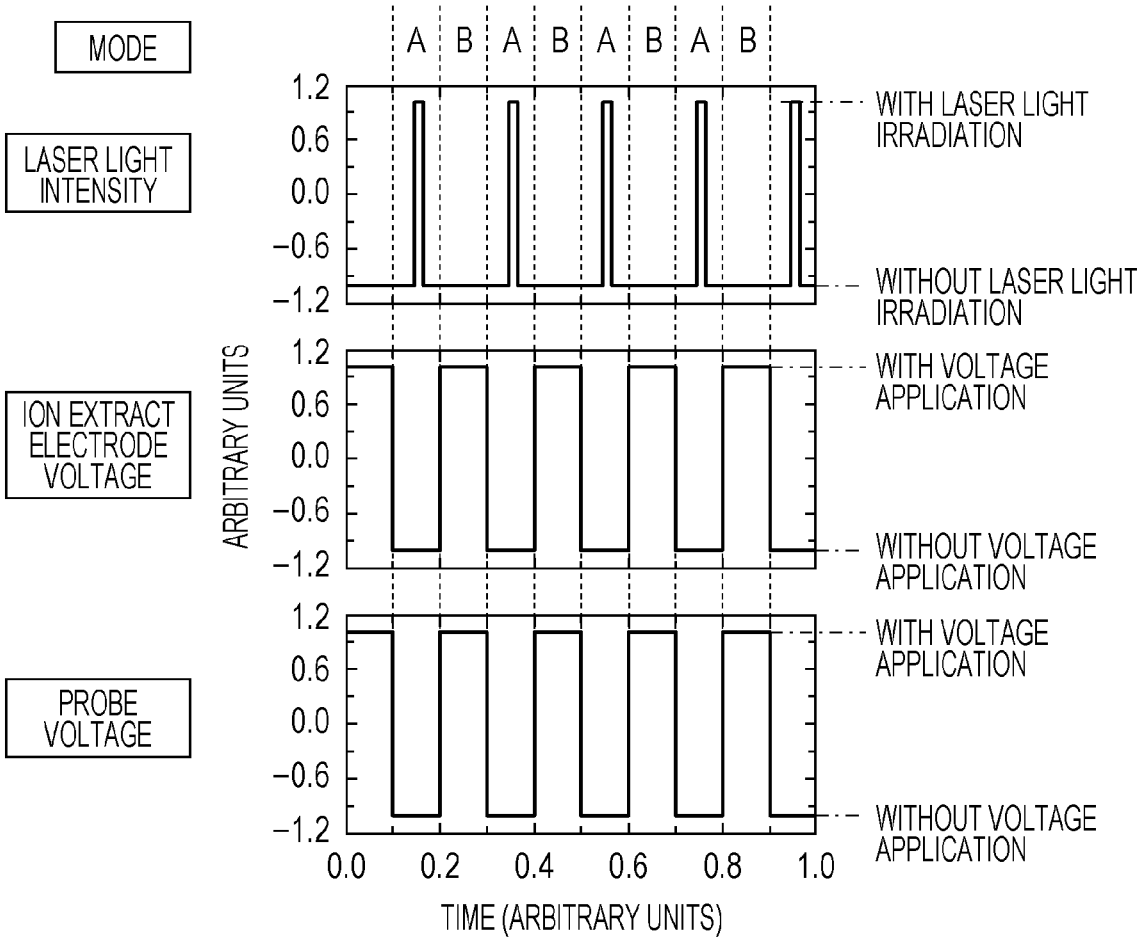
FIG. 2 is a chart illustrating modes in the ionization device and operation timings of constituent elements in the ionization device according to the first exemplary embodiment.

Examples of timings of laser light irradiation, application of a voltage to the ion extract electrode 7, and application of a voltage to the liquid holding unit 3 are illustrated in FIG. 2. In the mode A, the laser light is radiated and applications of the voltages are paused. In the mode B, the laser light is paused, and the voltages are applied. Although FIG. 2 indicates that the timing of the laser light irradiation falls at an intermediate position in the mode A, the timing of the laser light irradiation may be adjusted to any given point within the period of the mode A.

In the mode A, two settings are configured for application of a voltage to the ion extract electrode 7 and the liquid holding unit 3, namely with or without voltage application, in the first exemplary embodiment. Alternatively, the voltage may have two set levels in which one allows an electrospray to be generated and the other does not. That is, the settings for application of a voltage to the ion extract electrode 7 and the liquid holding unit 3 can include a voltage that generates an electrospray and a voltage that does not generate an electrospray, and then an appropriate voltage may be applied. Thus, if the fine particulate matter 23 is charged, the amount of the fine particulate matter 23 to be absorbed into the hanging liquid drop 21 can be advantageously increased. That is, if negatively charged fine particulate matter 23 is to be ionized, applying a positive voltage to the liquid holding unit 3 generates an electrostatic attraction, and thus the fine particulate matter 23 can be absorbed into the hanging liquid drop 21. Meanwhile, applying a negative voltage to positively charged fine particulate matter 23 may yield a similar effect. If both positively charged fine particulate matter 23 and negatively charge fine particulate matter 23 are generated, it is preferable to apply a positive voltage and a negative voltage in an alternating manner to the hanging liquid drop 21.

Second Exemplary Embodiment

An ionization device according to a second exemplary embodiment of the present invention has a configuration in which a distal end of the liquid holding unit 3 is caused to vibrate while the proximal end remains fixed (stationary). Points aside from the above are the same as those of the first exemplary embodiment.

Figure 3A:
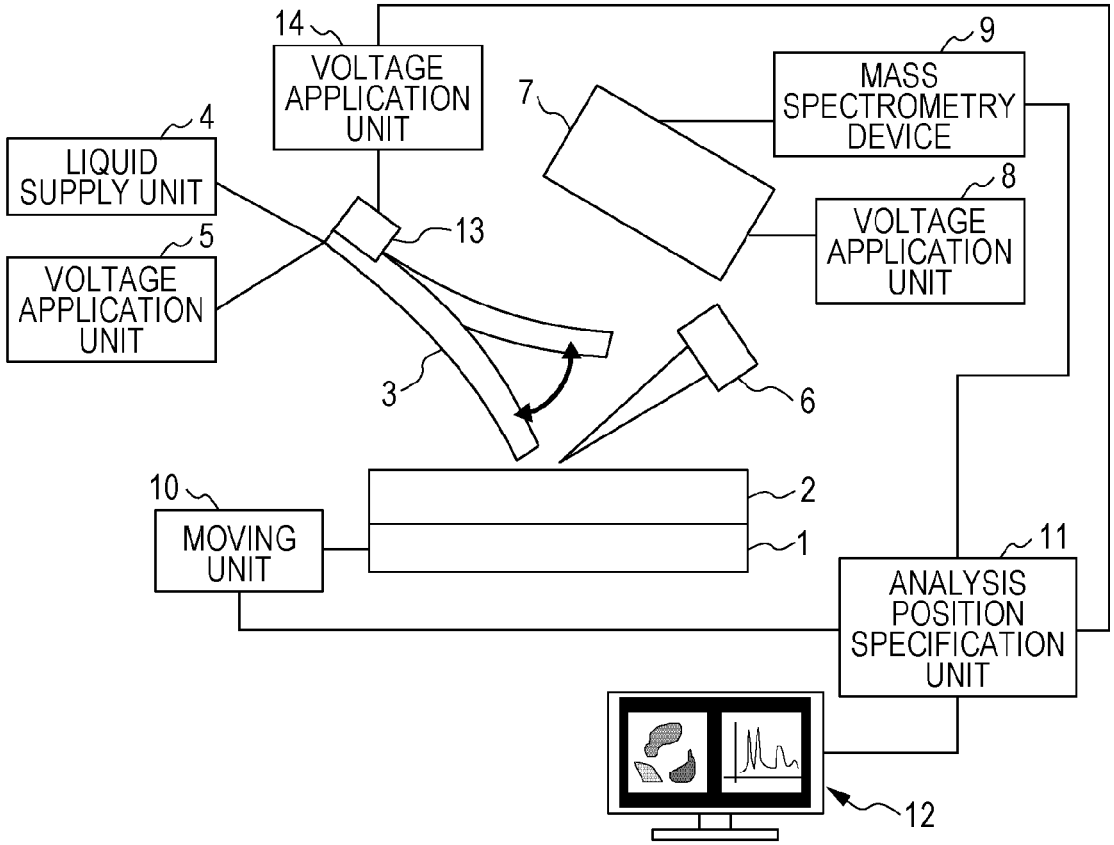
FIGS. 3A and 3B are schematic diagrams each illustrating an image generation system that includes an ionization device according to a second exemplary embodiment.
Figure 3B:
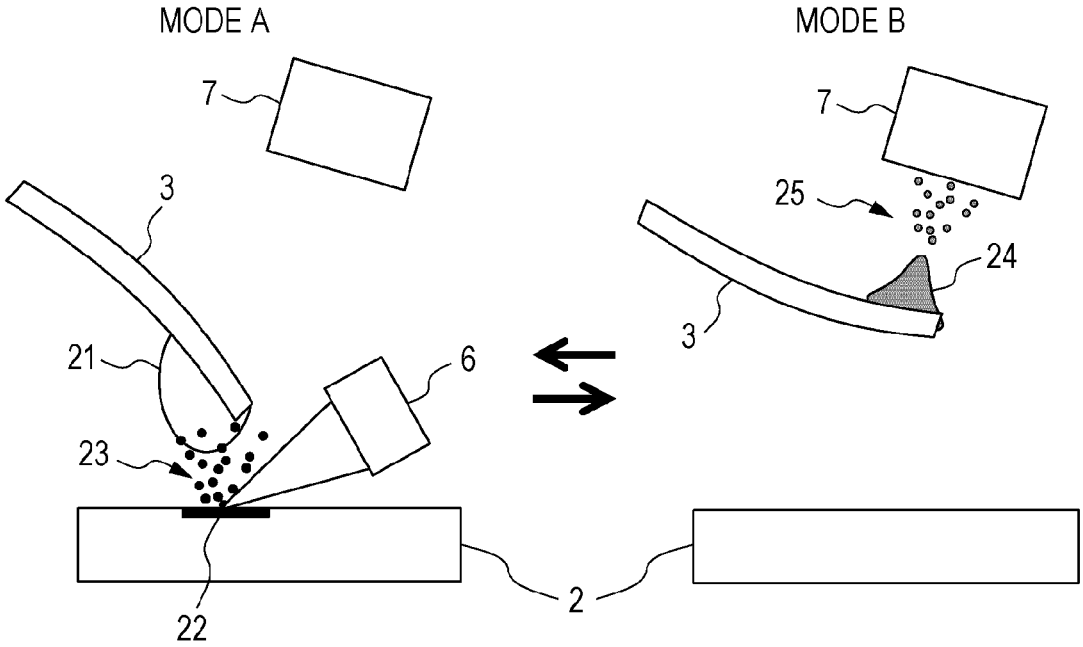

FIGS. 3A and 3B are schematic diagrams each illustrating the ionization device according to the second exemplary embodiment.

In the ionization device according to the second exemplary embodiment, the vibration unit 13 is provided on the liquid holding unit 3 instead of the support 1. The vibration unit 13 is connected to a voltage application unit 14, which is then connected to the analysis position specification unit 11. The vibration unit 13 causes the liquid holding unit 3 to vibrate in directions indicated by a double arrow in FIG. 3A.

The vibration unit 13 is formed by a piezoelectric element or a motor element and causes the liquid holding unit 3 to vibrate. The amplitude of the vibration of the liquid holding unit 3 is approximately a few tens of nanometers to a few millimeters, and the frequency is approximately 10 Hz or more and up to 1 MHz.

The liquid holding unit 3 vibrates continuously and enters a state in which the distal end of the liquid holding unit 3 is in close proximity to the surface of the sample 2 and a state in which the distal end of the liquid holding unit 3 is in close proximity to the ion extract electrode 7. In the state where the distal end of the liquid holding unit 3 is in close proximity to the surface of the sample 2, a voltage applied to the liquid holding unit 3 and the ion extract electrode 7 is stopped or kept to a low voltage, and thus the hanging liquid drop 21 is formed at the distal end of the liquid holding unit 3. The hanging liquid drop 21 is retained at a position where the hanging liquid drop 21 does not make contact with the sample 2. Meanwhile, in the state where the distal end of the liquid holding unit 3 is in close proximity to the ion extract electrode 7, a voltage is applied to the liquid holding unit 3 and the ion extract electrode 7. Thus, the Taylor cone 24 is formed at the distal end of the liquid holding unit 3, and electrospray ionization occurs.

Similarly to the first exemplary embodiment, the laser light irradiation unit 6 that emits the laser light includes a light source that is arranged such that the laser light hits the fine region 22 of the sample 2 that is in close proximity to the hanging liquid drop 21. The fine particulate matter 23 is desorbed from the surface of the sample 2 as a result of being irradiated with the laser light, and the fine particulate matter 23 collides with the hanging liquid drop 21 and is absorbed therein. The above processes will be referred to as the first operation mode (mode A).

Subsequently, as a voltage is applied to the liquid holding unit 3 and the ion extract electrode 7, electrospray ionization occurs at the distal end of the liquid holding unit 3, and ions of components included in the fine particulate matter 23 are generated. The above processes will be referred to as the second operation mode (mode B).

When the mode A and the mode B are carried out separately using the vibrating liquid holding unit 3, as in the second exemplary embodiment, an effect that differs from that of the first exemplary embodiment can be obtained. That is, when transitioning from the mode A to the mode B, the distance between the distal end of the liquid holding unit 3 and the ion extract electrode 7 decreases, and thus the electric field strength between the two is enhanced. As a result, the electric field strength at the distal end is enhanced during electrospray, and thus efficiency of the electrospray is improved.

In the ionization device according to the second exemplary embodiment, the vibration unit 13 causes the liquid holding unit 3 to vibrate. Alternatively, spontaneous resonance of the liquid holding unit 3 may be utilized without providing a vibration unit. For example, the size and the material of the liquid holding unit 3, the size of the flow channel formed in the liquid holding unit 3, the voltage applied thereto, and the flow rate of the solvent are set as follows.

Size of liquid holding unit: 10 μm to 100 mm in length
Material: glass, stainless steel, silicon, PMMA
Size of flow channel: 1 $\mu m^2$ to 1 $mm^2$ in cross section
Applied voltage: 0 V to ±10 kV
Flow rate of solvent: 1 nL to 1000 μL per minute In the ionization device according to the second exemplary embodiment, the vibration unit 13 vibrates continuously. Alternatively, in an ionization device according to an exemplary embodiment of the present invention, the vibration unit 13 may vibrate intermittently as long as mass spectrometry on an ionized substance can be carried out. Here, "vibrating intermittently" refers to a case in which states where the liquid holding unit 3 vibrates and is stopped are repeated alternately or a case in which the amplitude and/or the cycle of vibration of the liquid holding unit 3 change repeatedly.

The vibration frequency to be set in the vibration unit 13 is either a resonance frequency or a non-resonance frequency.

In the ionization device according to the second exemplary embodiment, the distal end of the liquid holding unit 3 vibrates between the sample 2 and the ion extract electrode 7. Alternatively, in an ionization device according to an exemplary embodiment of the present invention, the liquid holding unit 3 may rotate in addition to vibrating. If the liquid holding unit 3 is to rotate, a desired vibration in two axial directions that are orthogonal to each other may be given to the liquid holding unit 3. In this case, the liquid holding unit 3 vibrates in a combined wave pattern of two sine waves.

In the ionization device according to the second exemplary embodiment, the liquid supply unit 4 continuously supplies the solvent to a space between the liquid holding unit 3 and the sample 2. Alternatively, in an ionization device according to an exemplary embodiment of the present invention, the liquid supply unit 4 may supply the solvent to a space between the liquid holding unit 3 and the sample 2 while the liquid holding unit 3 is in close proximity to the sample 2 and may stop supplying the solvent while the liquid holding unit 3 is spaced apart from the sample 2. That is, the supply of the solvent and the vibration of the liquid holding unit 3 may be synchronized.

The vibration of the liquid holding unit 3 in the ionization device according to the second exemplary embodiment can be detected with various methods. For example, a side face of the liquid holding unit 3 may be irradiated with the laser light, and displacement of reflected light from the liquid holding unit 3 may be detected. As another example, an electric element for detecting a vibration may be connected to the liquid holding unit 3, and distortion in the liquid holding unit 3 may be detected on the basis of a change in electric resistance of the element. As yet another example, a magnetic member may be connected to the liquid holding unit 3, and a change in an induced current that flows in a coil disposed close to the liquid holding unit 3 may be detected.

In the ionization device according to the second exemplary embodiment, as in the first exemplary embodiment, the fine region 22 of the sample 2 may be irradiated with the laser light intermittently for a given period of time in the mode A, and thus a similar effect to that of the first exemplary embodiment can be obtained. That is, a period in which the laser light interacts with a substance that is easily decomposed by the laser light can be reduced, and thus decomposition of the substance can be reduced. In addition, the above configuration can suppress a situation where the fine region 22 of the sample 2 is locally heated by the laser light, and thus degradation of the substance to be caused by the heat can be suppressed.

If the liquid holding unit 3 vibrates, synchronization of formation of the hanging liquid drop 21, a timing of laser light irradiation, and application of a voltage to the liquid holding unit 3 and the ion extract electrode 7 can be achieved by adjusting the frequency and the phase of the vibration of the liquid holding unit 3 and the frequency and the phase of a control signal for the laser light. It is preferable to synchronize a displacement signal of the vibration of the liquid holding unit 3, a signal for controlling a timing of laser light irradiation, and a control signal for voltage application using a synchronization circuit.

Figure 4:
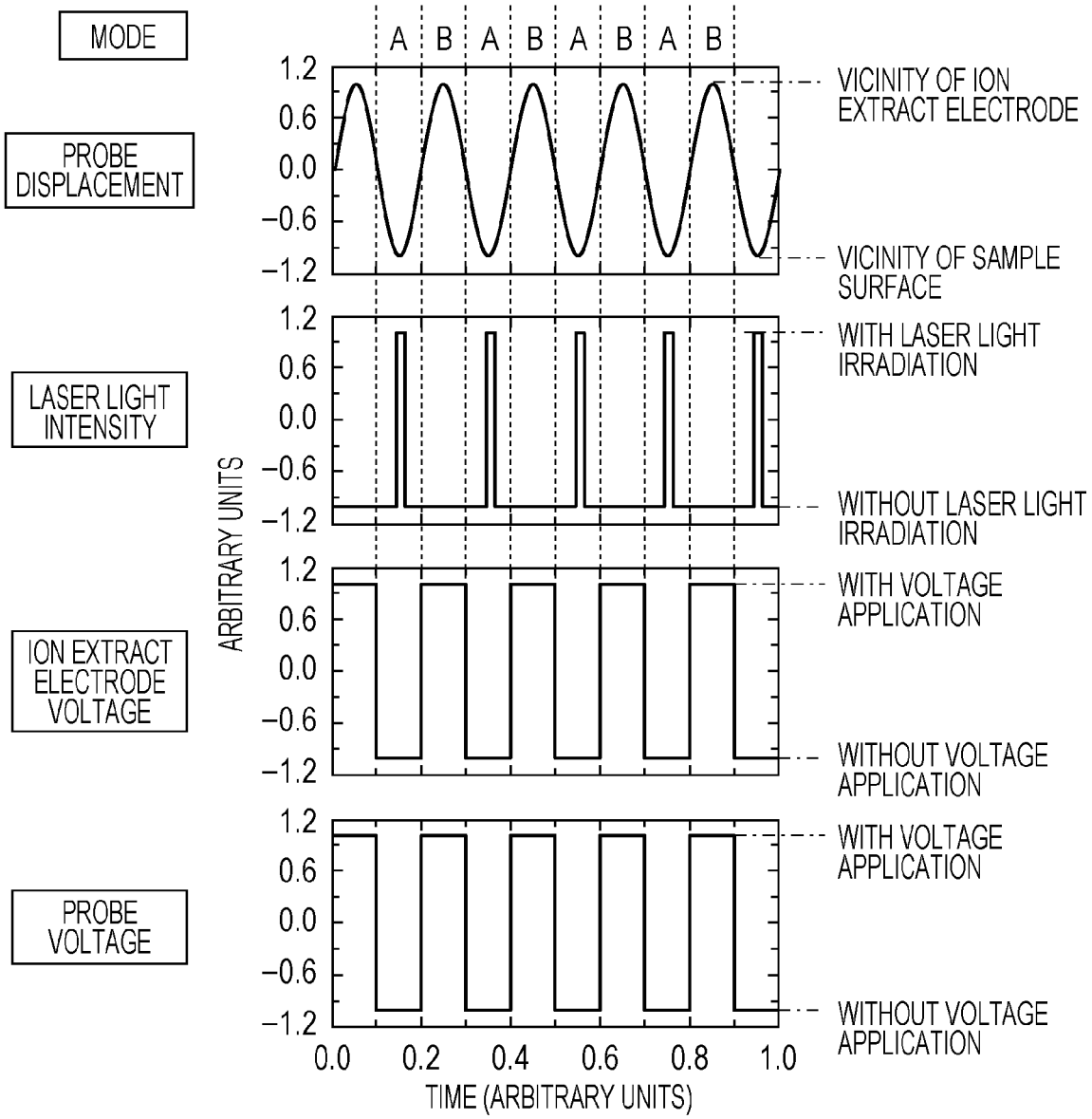
FIG. 4 is a chart illustrating modes in the ionization device and operation timings of constituent elements in the ionization device according to the second exemplary embodiment.

In the ionization device according to the second exemplary embodiment, the vibration timing of the liquid holding unit 3 and a timing of applying a voltage to the ion extract electrode 7 are preferably synchronized. Then, unnecessary ions generated during a period in which the fine particulate matter 23 is not generated and only the hanging liquid drop 21 is formed are not detected, and thus noise in the obtained measurement data can be reduced. Here, the synchronization of the vibration timing of the liquid holding unit 3 with the timing of the laser light irradiation described above may be carried out additionally (see FIG. 4). Alternatively, a voltage may be applied to the ion extract electrode 7 steadily.

Two settings are configured for application of a voltage to the ion extract electrode 7 and the liquid holding unit 3, namely with or without voltage application, in the second exemplary embodiment. Alternatively, the voltage may have two set levels in which one allows an electrospray to be generated and the other does not, as in the first exemplary embodiment. That is, the settings for application of a voltage to the ion extract electrode 7 and the liquid holding unit 3 can include a voltage that generates an electrospray and a voltage that does not generate an electrospray, and then an appropriate voltage may be applied.

Synchronization of the formation of the hanging liquid drop 21, irradiation of the laser light, and the timing of applying a voltage to the ion extract electrode 7 and the liquid holding unit 3 can be achieved by adjusting the frequencies and the phases of the vibration of the liquid holding unit 3, the control signal for the laser light, and the control signal for voltage application. These signals are preferably synchronized through a synchronization circuit.

Figure 5:
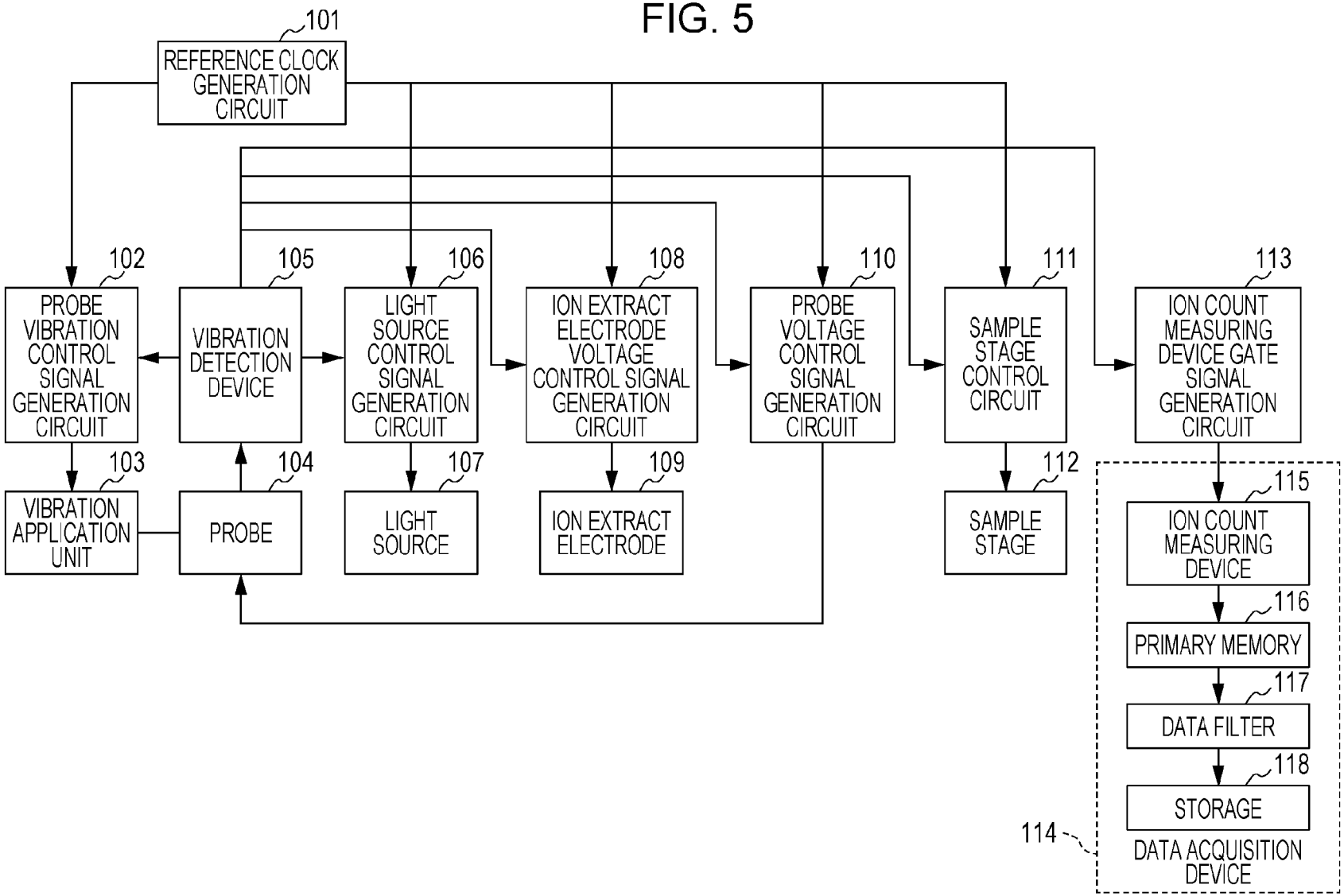
FIG. 5 is a schematic diagram illustrating a synchronization circuit of an ionization device according to an exemplary embodiment of the present invention.

In the ionization device according to the second exemplary embodiment, it is necessary to precisely adjust the timing at which a probe vibrates, the timing of laser light irradiation, application of a voltage to an extract electrode, a voltage applied to the probe, the timing at which a sample stage is moved, and acquisition and storage of data. An exemplary embodiment of a synchronization circuit for achieving the above is illustrated in FIG. 5.

The synchronization circuit of the exemplary embodiment includes a reference clock generation circuit 101, a probe vibration control signal generation circuit 102, a vibration application unit 103, a probe 104, a vibration detection device 105, a light source control signal generation circuit 106, a light source 107, an extract electrode voltage control signal generation circuit 108, an extract electrode 109, a probe voltage control signal generation circuit 110, a sample stage control circuit 111, a sample stage 112, an ion count measuring device gate signal generation circuit 113, and a data acquisition device 114. The data acquisition device 114 includes an ion count measuring device 115, a primary memory 116, a data filter 117, and a storage 118.

Here, a case where a field programmable gate array (FPGA) or an application specific integrated circuit (ASIC) is used will be described as an example. The use of the FPGA or the ASIC makes it possible to implement a plurality of control circuits (i.e., reference clock generation circuit 101, probe vibration control signal generation circuit 102, light source control signal generation circuit 106, extract electrode voltage control signal generation circuit 108, probe voltage control signal generation circuit 110, sample stage control circuit 111) on an integrated circuit and to precisely adjust their control timings at high speed.

The probe vibration control signal generation circuit 102, the light source control signal generation circuit 106, the extract electrode voltage control signal generation circuit 108, the probe voltage control signal generation circuit 110, the sample stage control circuit 111, and the ion count measuring device gate signal generation circuit 113 generate respective voltage signals and output the generated voltage signals to the vibration application unit 103, the light source 107, the extract electrode 109, the probe 104, the sample stage 112, and the ion count measuring device 115, respectively. Each of these voltage signals may be any one of a triangular wave, a square wave, a sine wave, and a cosine wave.

A feedback circuit is formed in the probe vibration control signal generation circuit 102 in order to bring a phase difference between a voltage signal obtained by detecting an actual vibration of the probe 104 and a voltage signal generated on the basis of a reference clock to zero, and driving this feedback circuit allows the probe 104 to vibrate at a constant frequency. The vibration detection device 105 is used to detect the actual vibration of the probe 104, and an output signal from the vibration detection device 105 is inputted to the feedback circuit in the probe vibration control signal generation circuit 102. Such a drive mechanism is known as a phase locked loop (PLL). Providing a delay compensation circuit within a circuit for the PLL makes it possible to generate a voltage signal having a desired delay time relative to a reference signal.

The output signal from the vibration detection device 105 is also inputted to the light source control signal generation circuit 106, the extract electrode voltage control signal generation circuit 108, the probe voltage control signal generation circuit 110, the sample stage control circuit 111, and the ion count measuring device gate signal generation circuit 113. Certain times such as a timing at which the probe 104 forms a liquid bridge, a timing at which ionization occurs at the distal end of the probe 104, and a timing between the liquid bridge formation and the ionization are extracted on the basis of the inputted voltage signals, and driving of the devices that are connected to the respective circuits at the aforementioned timings are controlled. For example, a signal of displacement of the probe 104 in FIG. 4 serves as an output signal from the vibration detection device 105, and when this signal is inputted to the light source control signal generation circuit 106, the extract electrode voltage control signal generation circuit 108, the probe voltage control signal generation circuit 110, and the sample stage control circuit 111, a specific threshold voltage may be set. Then, a period in which a voltage falls below the threshold voltage can be set as a timing of forming a liquid bridge, or a period in which a voltage exceeds the threshold voltage can be set as a timing at which ionization occurs. Then, a timing at which a voltage is applied to the probe 104, a timing at which the light source 107 emits light, a timing at which a voltage is applied to the extract electrode 109, and a timing at which the sample stage 112 is moved are controlled so as to synchronize with the timings determined as described above. Further, using a signal from the reference clock generation circuit 101 makes it possible to quantitatively measure and to control a timing at which a voltage is applied to the probe 104, a timing at which the light source 107 emits light, a timing at which a voltage is applied to the extract electrode 109, and a timing at which the sample stage 112 is moved.

An output signal generated by the ion count measuring device gate signal generation circuit 113 is inputted to the ion count measuring device 115 as a gate voltage signal. Generally, the ion count measuring device 115 intermittently receives a trigger signal from the mass spectrometer, and after receiving the trigger signal, the ion count measuring device 115 measures the number of ions that have reached the detector in the mass spectrometer. A trigger signal differs depending on the configuration of an ion separation unit in the mass spectrometer. In the exemplary embodiment, a quadrupole mass spectrometer, a TOF mass spectrometer, a magnetic field deflection mass spectrometer, or an ion trap mass spectrometer may be used as the mass spectrometer, and a specific timing may be used as a trigger signal for each instance of mass spectrometry.

For example, a signal indicating a timing of starting application of a high frequency voltage to a quadrupole electrode may be used as a trigger signal in the quadrupole mass spectrometer. In the TOF mass spectrometer, a signal indicating a timing of application of a pulse voltage for accelerating an ion in a device that measures the time of flight of the ion may be used as a trigger signal. In the magnetic field deflection mass spectrometer, a signal indicating a timing at which a magnetic field starts to be applied to a sector electrode may be used as a trigger signal. In the ion trap mass spectrometer, a signal indicating a timing at which an ion is introduced to an ion trap may be used as a trigger signal. Typically, the frequency of the pulse voltage in the TOF mass spectrometer is approximately a few kHz to a few tens of kHz, and the frequency of trapping ions in the ion trap mass spectrometer is approximately a few tens of Hz to a few kHz. Thus, the frequency is often higher than the vibration frequency of the probe 104.

In the exemplary embodiment, a gate voltage signal is outputted in synchronization with a timing at which ionization occurs at the distal end of the probe 104. The ion count measuring device 115 is configured to operate in accordance with a period in which the gate signal is outputted. Here, the gate signal is any one of a positive voltage, a negative voltage, and a zero voltage and differs depending on the ion count measuring device 115. The ion count measuring device 115 can be configured to operate only while ions are generated at the probe 104, and thus a noise signal is not measured while the liquid bridge is formed and during period from when the liquid bridge is formed until the ionization occurs. Therefore, a noise signal to be contained in a signal of measured data can be reduced.

Subsequently, a method for recording a voltage signal from the ion count measuring device 115 in the form of digital data will be described. A signal from the ion count measuring device 115 undergoes analog-to-digital conversion and is then temporarily stored in the primary memory 116. Measurement data that corresponds to the type of ions to be measured is selected and stored in the storage 118 such as a hard disk drive (HDD) and a solid state drive (SSD). This process of selecting the data is carried out through a program in the data filter 117, and the data is overwritten by new data in the memory. Since the data is stored in the storage 118 after being selected, the total amount of data can be reduced, and the selected data can be applied if the ion to be measured is determined in advance. Meanwhile, if an unknown ion is to be detected, the entire data obtained by the ion count measuring device 115 can be stored in the storage 118.

If a large area on a measurement target is to be measured, the sample stage 112 needs to be moved. The sample stage control circuit 111 generates a signal for controlling the position of the sample stage 112 on the basis of a reference clock and outputs the generated signal to the sample stage 112. At this point, by measuring a timing at which ionization occurs at the distal end of the probe 104 and the number of instances of ionization within a given period of time on the basis of the signal from the vibration detection device 105, the number of instances of ionization per position on a sample can be kept constant. Acquisition and storage of the data can be carried out successively while moving the sample stage 112. Thus, pieces of two-dimensional data on the measurement target can be stored successively.

Thus far, a case where the signal generation circuits generate respective output signals relative to a threshold has been described, but the exemplary embodiments are not limited thereto. A common signal generation circuit may be provided separately, and the common signal generation circuit may extract specific times on the basis of a signal from the vibration detection device 105. Then, the common signal generation circuit may input a voltage signal corresponding to the extracted times to the light source control signal generation circuit 106, the extract electrode voltage control signal generation circuit 108, the probe voltage control signal generation circuit 110, the sample stage control circuit 111, and the ion count measuring device gate signal generation circuit 113.

In the exemplary embodiment, a synchronization method in a case where the probe 104 vibrates has been described. Alternatively, if the probe 104 is paused, the probe vibration control signal generation circuit 102, the vibration application device 103, and the vibration detection device 105 that relate to the vibration of the probe 104 may be stopped, and various control signals may be generated using signals from the reference clock generation circuit 101 in the respective control circuits.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-197207, filed Sep. 7, 2012, which is hereby incorporated by reference herein in its entirety.

What is claimed is:

1. An ionization device, comprising:

a laser light irradiation unit configured to irradiate at least a region of a surface of a sample with laser light to desorb a particle contained on the surface of the sample;

a liquid holding unit having a distal end and a proximal end, the liquid holding unit being configured to hold a liquid on an outer periphery of the distal end;

an extract electrode configured to extract an ionized ion; and a voltage application unit configured to apply a voltage between the liquid and the extract electrode to cause the ion to generate from the liquid held on the outer periphery of the distal end, wherein the region and the distal end are disposed so as not to make contact with each other but to be in close proximity to each other so that the liquid held on the outer periphery of the distal end collects the particle desorbed from the sample as a result of being irradiated with the laser light, wherein the particle is ionized using the liquid held on the outer periphery of the distal end, and wherein the liquid holding unit has an elongated shape and flexibly vibrates relative to a longitudinal axis of the liquid holding unit, and both the collection of the particle into the liquid and the ionization of the particle are performed at the distal end of the liquid holding unit alternately within a range in which the distal end flexibly vibrates.

2. The ionization device according to claim 1, wherein a position of the distal end when the liquid collects the desorbed particle differs from a position of the distal end when the particle is ionized.

3. The ionization device according to claim 1, further comprising:

a vibration unit configured to cause the distal end of the liquid holding unit to vibrate.

4. The ionization device according to claim 1, further comprising:

a drive unit configured to drive the laser light irradiation unit to emit pulsed laser light.

5. The ionization device according to claim 1, further comprising:

a scanning unit configured to scan the surface of the sample while relatively moving the distal end and the laser light.

6. The ionization device according to claim 5, wherein the scanning unit is configured to scan while retaining a positional relationship between the distal end and the laser light.

7. The ionization device according to claim 1, wherein the liquid holding unit includes a flow channel having an opening at the distal end, the flow channel being formed inside the liquid holding unit for supplying the liquid to the outer periphery of the distal end.

8. The ionization device according to claim 1, wherein the liquid holding unit includes an electrode for applying a voltage to the liquid held on the outer periphery of the distal end.

9. The ionization device according to claim 1, further comprising:

a synchronization circuit configured to synchronize a timing of laser light irradiation with a timing at which a liquid holding unit vibrates.

10. The ionization device according to claim 1, further comprising:

a synchronization circuit configured to synchronize a timing of laser light irradiation with a timing at which a voltage is applied between the liquid and the extract electrode.

11. The ionization device according to claim 1, further comprising:

a synchronization circuit configured to synchronize a timing of laser light irradiation with an operation timing of an ion count measuring device connected to the ionization device.

12. The ionization device according to claim 1, further comprising:

a synchronization circuit configured to synchronize a timing of laser light irradiation with a timing at which a voltage is applied to the extract electrode of the ionization device.

13. The ionization device according to claim 1, further comprising:

a synchronization circuit configured to synchronize a timing of laser light irradiation with at least two of a timing at which a liquid holding unit vibrates, a timing at which a voltage is applied between the liquid and the extract electrode, an operation timing of an ion count measuring device connected to the ionization device, and a timing at which a voltage is applied to an ion take-in extract electrode of the ionization device.

14. The ionization device according to claim 1, wherein the collection of the particle into the liquid and the ionization of the particle are performed on different side surfaces of the distal end of the liquid holding unit.

15. The ionization device according to claim 1, wherein the collection of the particle is performed on a side surface of the distal end of the liquid holding unit which faces the surface of the sample, and the ionization of the particle is performed on a side surface of the distal end of the liquid holding unit which faces the extract electrode.

16. A mass spectrometer, comprising:

the ionization device according to claim 1 serving as an ionization unit; and a mass spectrometry unit configured to analyze a mass of the ion.

17. An image generation system, comprising:

the mass spectrometer according to claim 16; and an image information generation device that includes an image generation unit configured to generate image information to be used to display an image of a component distribution of a substance contained in the sample on the basis of mass information obtained through analysis by the mass spectrometer and positional information on the region of the surface of the sample, and an output unit configured to output the image information to a display device.

18. A method for analyzing a sample using an ionizing device, comprising:

irradiating at least a region of a surface of the sample with laser light to desorb a particle from the sample;

providing a liquid through a liquid holding unit having a distal end thereof such that the liquid is held on an outer periphery of the distal end;

disposing the region and the distal end so as not to make contact with each other but to be in close proximity to each other so that the liquid held on the outer periphery of the distal end collects the particle desorbed as a result of being irradiated with the laser light; and applying a voltage between the liquid held on the outer periphery of the distal end and an extract electrode to cause ionizing of the particle using the liquid at the distal end, wherein the liquid holding unit has an elongated shape and flexibly vibrates relative to a longitudinal axis of the liquid holding unit, and both the collection of the particle into the liquid and the ionization of the particle are performed at the distal end of the liquid holding unit alternately within a range in which the distal end flexibly vibrates.

19. The method according to claim 18, further comprising:

vibrating the liquid holding unit so that the distal end thereof moves alternately close to and away from the region.

20. The method according to claim 19, further comprising:

guiding the ionized particle to a mass spectrometry unit; and carrying out mass spectrometry with the mass spectrometry unit.

21. The method according to claim 18, wherein the collection of the particle into the liquid and the ionization of the particle are performed on different side surfaces of the distal end of the liquid holding unit.

22. The method according to claim 18, wherein the collection of the particle is performed on a side surface of the distal end of the liquid holding unit which faces the surface of the sample, and the ionization of the particle is performed on a side surface of the distal end of the liquid holding unit which faces the extract electrode.

23. An ionization device, comprising:

a laser light irradiation unit configured to irradiate at least a region of a surface of a sample with laser light to desorb a particle contained on the surface of the sample;

a liquid holding unit having a distal end and a proximal end, the liquid holding unit being configured to hold a liquid on an outer periphery of the distal end;

an extract electrode configured to extract an ionized ion; and a voltage application unit configured to apply a voltage between the liquid and the extract electrode to cause the ion to generate from the liquid held on the outer periphery of the distal end, wherein the region and the distal end are disposed so as not to make contact with each other but to be in close proximity to each other so that the liquid held on the outer periphery of the distal end collects the particle desorbed from the sample as a result of being irradiated with the laser light, wherein the particle is ionized using the liquid held on the outer periphery of the distal end, wherein a position of the proximal end when the liquid collects the desorbed particle is the same as a position of the proximal end when the particle is ionized, and wherein the collection of the particle into the liquid and the ionization of the particle are performed on different side surfaces of the distal end of the liquid holding unit.

24. An ionization device, comprising:

a laser light irradiation unit configured to irradiate at least a region of a surface of a sample with laser light to desorb a particle contained on the surface of the sample;

a liquid holding unit having a distal end and a proximal end, the liquid holding unit being configured to hold a liquid on an outer periphery of the distal end;

an extract electrode configured to extract an ionized ion; and a voltage application unit configured to apply a voltage between the liquid and the extract electrode to cause the ion to generate from the liquid held on the outer periphery of the distal end, wherein the region and the distal end are disposed so as not to make contact with each other but to be in close proximity to each other so that the liquid held on the outer periphery of the distal end collects the particle desorbed from the sample as a result of being irradiated with the laser light, wherein the particle is ionized using the liquid held on the outer periphery of the distal end, wherein both the collection of the particle into the liquid and the ionization of the particle are performed at the distal end of the liquid holding unit alternately, and wherein the collection of the particle into the liquid and the ionization of the particle are performed on different side surfaces of the distal end of the liquid holding unit.

25. An ionization device, comprising:

a laser light irradiation unit configured to irradiate at least a region of a surface of a sample with laser light to desorb a particle contained on the surface of the sample;

a liquid holding unit having a distal end and a proximal end, the liquid holding unit being configured to hold a liquid on an outer periphery of the distal end;

an extract electrode configured to extract an ionized ion; and a voltage application unit configured to apply a voltage between the liquid and the extract electrode to cause the ion to generate from the liquid held on the outer periphery of the distal end, wherein the region and the distal end are disposed so as not to make contact with each other but to be in close proximity to each other so that the liquid held on the outer periphery of the distal end collects the particle desorbed from the sample as a result of being irradiated with the laser light, wherein the particle is ionized using the liquid held on the outer periphery of the distal end, wherein a position of the proximal end when the liquid collects the desorbed particle is the same as a position of the proximal end when the particle is ionized, and wherein the collection of the particle is performed on a side surface of the distal end of the liquid holding unit which faces the surface of the sample, and the ionization of the particle is performed on a side surface of the distal end of the liquid holding unit which faces the extract electrode.

26. An ionization device, comprising:

a laser light irradiation unit configured to irradiate at least a region of a surface of a sample with laser light to desorb a particle contained on the surface of the sample;

a liquid holding unit having a distal end and a proximal end, the liquid holding unit being configured to hold a liquid on an outer periphery of the distal end;

an extract electrode configured to extract an ionized ion; and a voltage application unit configured to apply a voltage between the liquid and the extract electrode to cause the ion to generate from the liquid held on the outer periphery of the distal end, wherein the region and the distal end are disposed so as not to make contact with each other but to be in close proximity to each other so that the liquid held on the outer periphery of the distal end collects the particle desorbed from the sample as a result of being irradiated with the laser light, wherein the particle is ionized using the liquid held on the outer periphery of the distal end, wherein both the collection of the particle into the liquid and the ionization of the particle are performed at the distal end of the liquid holding unit alternately, and wherein the collection of the particle is performed on a side surface of the distal end of the liquid holding unit which faces the surface of the sample, and the ionization of the particle is performed on a side surface of the distal end of the liquid holding unit which faces the extract electrode.

* * * * *